US005228566A

United States Patent [19]

Shenoha

[11] Patent Number: 5,228,566

[45] Date of Patent: Jul. 20, 1993

[54] GOLF BAG TOP AND CLUB SEPARATOR

[75] Inventor: James L. Shenoha, Lockport, Ill.

[73] Assignee: Wilson Sporting Goods Co., Chicago, Ill.

[21] Appl. No.: 874,815

[22] Filed: Apr. 28, 1992

[51] Int. Cl.[5] ..... A63B 55/00

[52] U.S. Cl. ..... 206/315.6; 206/315.7

[58] Field of Search ..... 206/315.2–315.8; 211/70.2; 248/96

[56] References Cited

U.S. PATENT DOCUMENTS

| | | | |
|---|---|---|---|
| 1,840,183 | 1/1932 | Blitch | 206/315.6 |
| 1,849,610 | 3/1932 | Boyce | 206/315.6 |
| 2,064,542 | 12/1936 | Jones | 206/315.6 X |
| 2,436,687 | 2/1948 | Corbett | 206/315.6 |
| 2,534,096 | 12/1950 | Zapoleon | 206/315.6 |
| 2,607,382 | 8/1952 | Le Vine | 206/315.6 |
| 2,679,876 | 6/1954 | Schall . | |
| 2,879,819 | 3/1959 | Turnbull . | |
| 3,503,518 | 3/1970 | Black | 206/315.6 X |
| 3,534,795 | 10/1970 | Wiedenmeier . | |
| 3,941,398 | 3/1976 | Nelson . | |
| 4,055,207 | 10/1977 | Goodwin | 206/315.6 |
| 4,200,131 | 4/1980 | Chitwood et al. | 206/315.6 |
| 4,208,227 | 6/1980 | Cowan | 206/315.6 |
| 4,340,102 | 7/1982 | Isabel | 206/315.6 |
| 5,094,345 | 3/1992 | Yonnetti | 206/315.6 X |
| 5,135,107 | 8/1992 | Ingraham | 206/315.6 |

FOREIGN PATENT DOCUMENTS

| | | | |
|---|---|---|---|
| 421090 | 12/1934 | United Kingdom | 206/315.6 |
| 490428 | 8/1938 | United Kingdom | 206/315.6 |
| 2134797 | 8/1984 | United Kingdom | 206/315.3 |

*Primary Examiner*—Sue A. Weaver

[57] ABSTRACT

A golf bag top and club separator is provided with slots for retaining the heads of golf clubs. Each slot has a flat bottom surface, a first flat side surface which extends perpendicularly upwardly from the bottom surface, a second inclined flat side surface which forms an obtuse included angle with the bottom surface, and a shaft opening which extends through the bottom surface and the inclined side surface.

20 Claims, 3 Drawing Sheets

Fig. 1
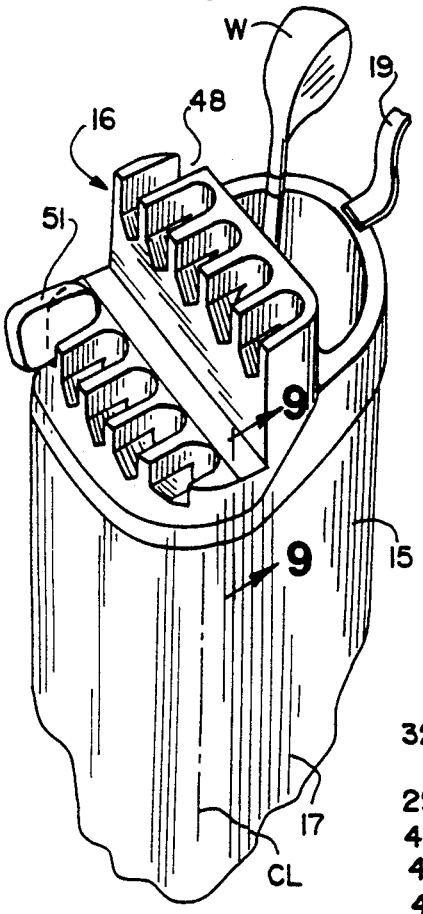
Fig. 2
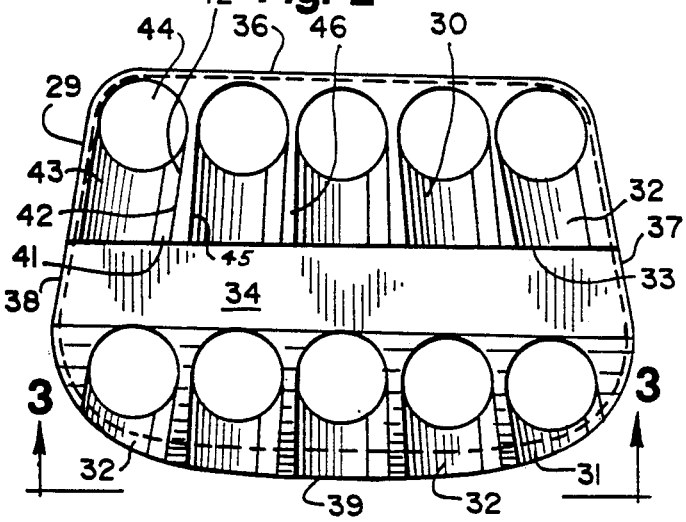
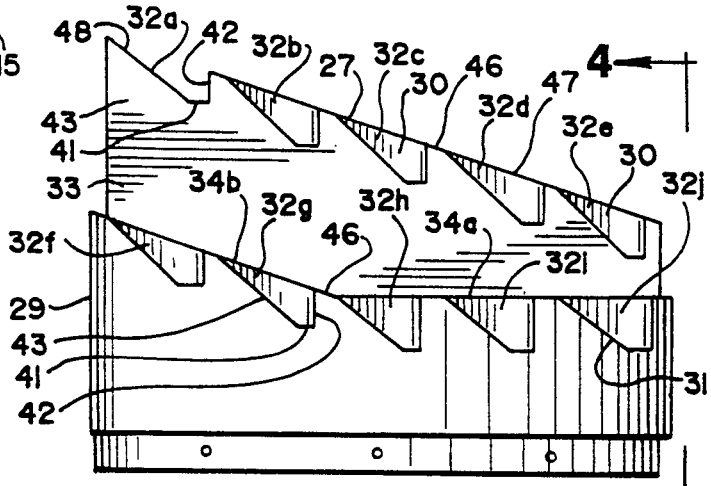
Fig. 3
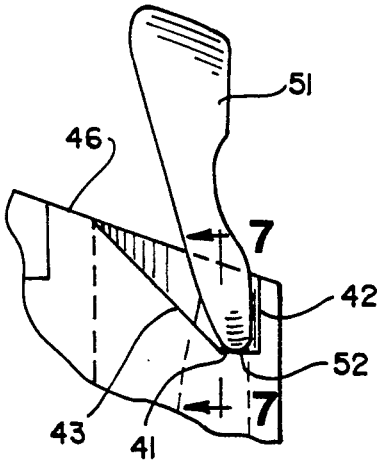
Fig. 5
Fig. 4
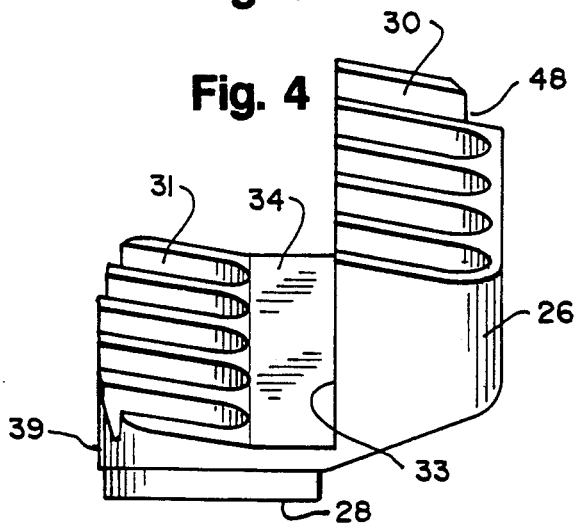

GOLF BAG TOP AND CLUB SEPARATOR

BACKGROUND

This invention relates to a golf bag top and club separator which organizes, retains, and protects the heads of golf clubs within individual slots.

Most golf bags include a top member which includes one or more partitions which form compartments. A plurality of golf clubs are inserted into each compartment. However, the heads of the clubs in each compartment remain free to shift about as the bag is carried, dropped, or lifted by a golfer or a caddie. The clubheads thereby become disorganized, and contact between the heads can cause the heads to become scratched.

Some efforts have been made to incorporate devices for retaining individual clubheads in a fixed position so that the clubheads remain organized and do not contact each other. For example, U.S. Pat. No. 4,055,207 describes a club retainer which is molded from resilient material and which includes wedge-shaped notches. The clubheads are releasably clamped within the notches. The clamping action apparently requires a different sized notch for each number of club.

U.S. Pat. No. 4,200,131 describes a first embodiment which includes a flat top surface and a plurality of inclined surfaces which extend upwardly from the top surface for supporting the faces of the clubheads. Each inclined surface extends at an angle corresponding to the loft angle of a particular number of club, so each club must be inserted into the proper place. A second embodiment is provided with indentations. The shape of each indentation is designed to accommodate a club having a particular loft angle.

U.S. Pat. No. 2,436,687 also describes a wedge type support which includes a plurality of fingers each of which is designed to cooperate with a particular club.

SUMMARY OF THE INVENTION

The invention provides a golf bag top and club separator which incudes two rows of staggered slots for retaining the heads of golf clubs. Each slot includes a flat bottom surface for supporting the top edge of a clubhead, an inclined side surface for guiding the clubhead to the bottom surface, and an upwardly extending side surface which provides a stop for retaining the clubhead on the bottom surface. Although each slot is advantageously associated with a particular club, the slots do not provide a wedging action, and each slot has substantially the same shape. It is therefore not necessary to insert a particular clubhead into a particular slot, and the club separator can be used with clubs from different manufacturers. The two rows of staggered slots distribute the weight of the clubs to provide good balance.

DESCRIPTION OF THE DRAWING

The invention will be explained in conjunction with an illustrative embodiment shown in the accompanying drawing, in which FIG. 1 is a perspective view of a golf bag which is equipped with a bag top and club separator in accordance with the invention;

FIG. 2 is a top plan view of the club separator;

FIG. 3 is a front elevational view of the club separator taken along the line 3—3 of FIG. 2;

FIG. 4 is a side elevational view of the club separator taken along the line 4—4 of FIG. 3;

FIG. 5 is an enlarged fragmentary front elevational view showing a clubhead in one of the slots;

DESCRIPTION OF SPECIFIC EMBODIMENT

The numeral 15 refers generally to a golf bag which may be conventional except for the bag top and club separator 16. The golf bag includes an elongated generally tubular body 17 and a bottom or base (not shown) which is attached to the body and closes the lower end of the body. A conventional bag strap 19 is attached to the bag for carrying the bag.

Figure 8:
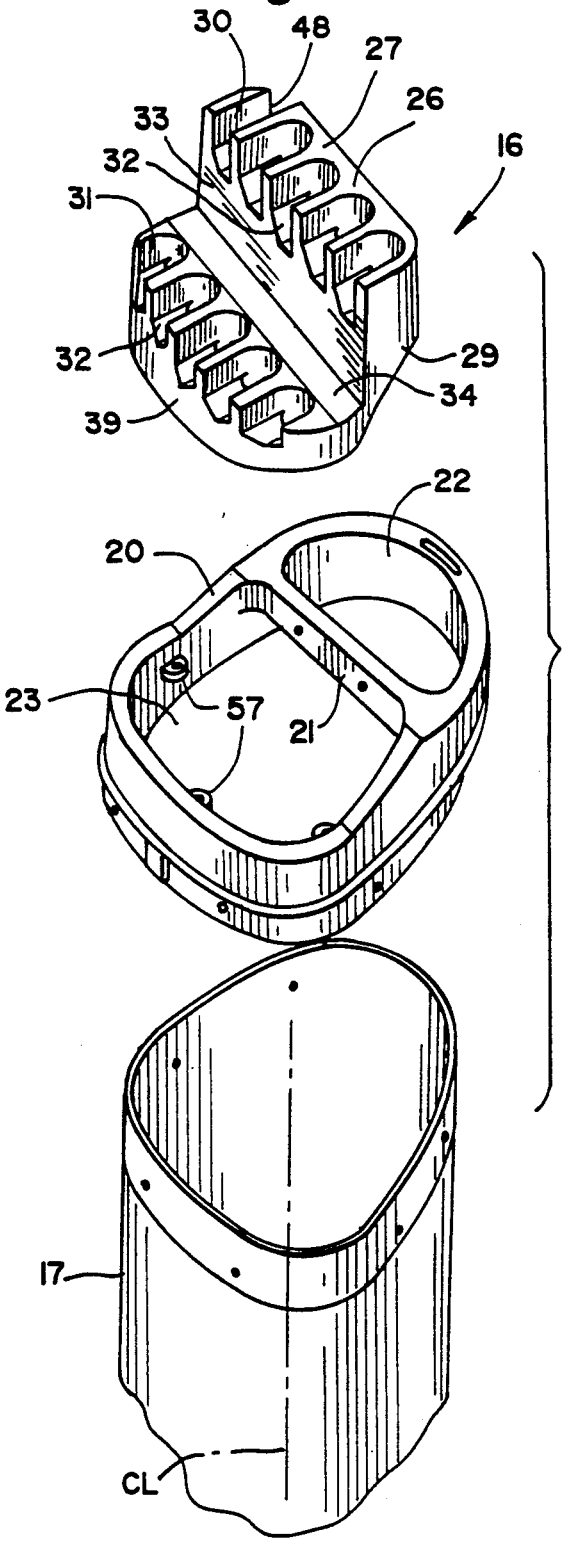
FIG. 8 is an exploded perspective view of the club separator and the top collar of the golf bag.

Referring to FIG. 8, the bag top and club separator 16 includes a collar 20 which is attached to the open upper end of the tubular body 17. The collar includes a partition 21 which divides the interior of the collar into first and second openings 22 and 23. The first opening 22 may be used for storing wood type clubs W, and a club separator 26 is positioned within the opening 23

The club separator 26 may be injection molded from suitable plastic, such as polyethylene, and includes top and bottom surfaces 27 and 28 (FIG. 3) and an outer side surface 29. Upper and lower rows 30 and 31 of club-retaining slots 32 are provided in the top surface 27.

The row 30 of slots is separated from the lower row 31 by an intermediate side wall 33 and a transverse wall 34. The intermediate side wall 33 extends in a plane which is parallel to the axis or centerline CL (FIGS. 1 and 8) of the tubular body 17 of the golf bag, and the transverse wall 34 extends generally perpendicularly to the intermediate wall 33. Referring to FIG. 3, the transverse wall includes a first portion 34*a* which extends perpendicularly to the axis of the tubular body 17 and an inclined portion 34*b* which extends at an angle to the axis.

The outer side wall 29 of the club separator includes a generally flat rear portion 36 (FIG. 2) which abuts the partition 21 of the collar 20, a pair of diverging side portions 37 and 38, and a front portion 39. The rear portion 36 faces toward the bag strap 19, and the front portion 39 faces generally downwardly when the bag is carried by the bag strap.

In the particular embodiment illustrated, the upper row 30 of slots includes 5 slots 32*a*–32*e*. Each of the slots includes a flat bottom surface 41 which extends generally perpendicularly to the axis of the body of the bag, an upwardly extending side surface 42 which extends perpendicularly to the bottom surface 41, and a flat inclined side surface 43. The inclined side surface forms an obtuse included angle with the bottom surface 41. A shaft opening 44 (FIG. 2) extends through the bottom surface 41 and inclined surface 43 for receiving the shaft of a golf club. Comparing FIGS. 2 and 3, the upwardly extending side surface 42 is tangent to the shaft opening 44, and the upper edge 45 of the inclined surface 43 is also tangent to the shaft opening. Each pair of adjacent slots is separated by a top surface 46 which extends between the upwardly extending side surface 42 of one slot and the inclined side surface 43 of the next slot.

Referring to FIG. 3, the slots 32 in the upper row 30 are staggered in a stepwise fashion. The first slot 32*a* is farther away from the bottom of the bag than the second slot 32*b*, etc. The bottom surfaces 41 of the slots are parallel to each other, and the upper edge 47 of the rear portion 36 of the outer side wall of the club separator is inclined relative to the axis of the bag portion.

The bottom surface 41 of each of the slots 32*a*–32*e* is positioned ½ inch farther away from the bottom of the bag than the bottom surface of the next slot. Each slot can therefore accommodate a different numbered club since the shafts of different numbered clubs generally vary by ½ inch between each pair of numbers. In the embodiment illustrated in FIGS. 1–9, the rear portion 36 of the outer side wall is notched away at 48 so that the first slot 32*a* extends through the side wall. The first slot can thereby accommodate a putter with a head which extends beyond the shaft in both the toe and the heel of the head. The remaining slots 32*b*–32*e* can accommodate irons numbered 3 through 6.

The bottom row 31 of slots also includes five slots 32*f* through 32*j*. Slots 32*f*–32*h* are staggered from the bottom of the bag in increments of ½ inch and can accommodate the 7 through 9 irons. Slot 32*f* is also ½ inch below slot 32*e*. Slots 32*i* and 32*j* are not staggered and can accommodate the pitching wedge and sand wedge, which often have the same shaft length.

It will be understood that other arrangements of the slots are possible. For example, the putter can be stored with the woods in the opening 22 in the collar, and a 2 iron can be stored in slot 32*a*. Also, the club separator can be provided with more or less slots. For example, a lady's or junior bag might need slots for only 6 or 7 irons.

Figure 6:
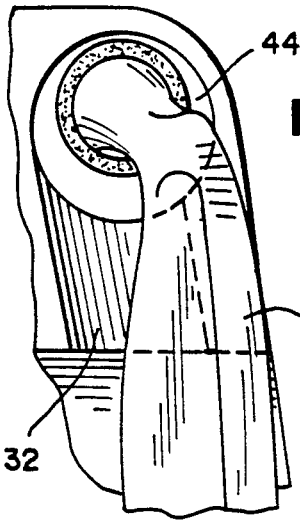
FIG. 6 is an enlarged fragmentary top view showing a clubhead in one of the slots.
Figure 7:
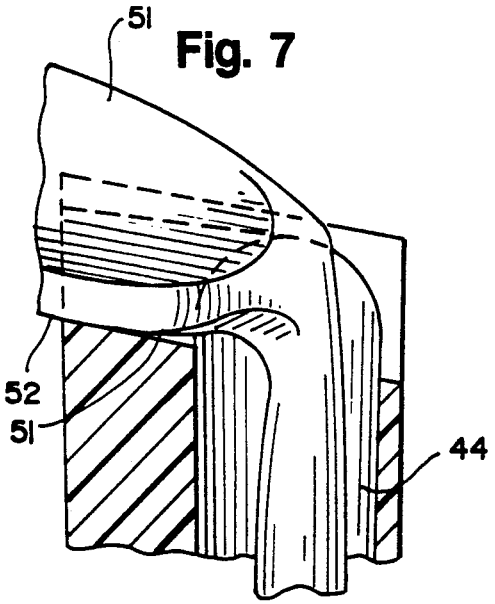
FIG. 7 is a fragmentary sectional view taken along the line 7—7 of FIG. 5.

FIGS. 5–7 illustrate the manner in which a club 51 is retained within one of the slots. As the shaft of the club is inserted into the shaft opening 44, the top edge 52 of the clubhead eventually engages the inclined surface 43. The inclined surface guides the clubhead to the bottom surface 41 as the club falls by gravity. The upwardly extending side surface 42 provides a stop for the club and retains the top edge of the clubhead on the bottom surface.

The inclined surface 43 of each of the slots extends at an angle of about 40° to 50° from the bottom surface 41, and the inclined surface is not designed to mate with the face of any particular club. It is therefore not necessary for a particular club to be inserted into a particular slot. The top edge 52 of most clubs extends substantially perpendicularly to the shaft, and when the club rests in the slot, it is supported substantially exclusively by the bottom surface 41. The bottom surface is wide enough to accommodate the top edge of different numbered clubs and clubs from different manufacturers. In one specific embodiment the width of each of the bottom surfaces was ¼ inch, and the diameter of each shaft opening was 1¼ inch.

The slots of the top row 30 extend through the intermediate side wall 33, and the slots of the bottom row 31 extend through the front portion 39 of the outer side wall. The length of the bottom surface 41 of each slot is less than the length of the clubhead from the shaft to the toe, and the toe portion of the clubhead extends beyond the side wall 33 or 39. The club can therefore be easily withdrawn from the slot by grasping the toe portion.

The slots are arranged so that the clubheads extend generally downwardly when the golf bag is carried by the bag strap. Referring to FIG. 2, the bottom surfaces 41 of the two center slots 32*c* and 32*h* extend perpendicularly to the front portion 39 of the outer side wall. The bottom surfaces of the slots 32*d* and 32*i* are angled 5° counterclockwise from the center slots, and the bottom surfaces of the slots 32*b* and 32*g* are angled 5° clockwise. Similarly, the slots 32*e* and 32*j* are angled 10° counterclockwise, and the slots 32*a* and 32*f* are angled 10° clockwise, from the center slots. The angle between adjacent slots ensures that the clubheads will be kept out of contact with other. The staggered arrangement of the two rows of slots and the direction of the slots distributes the weight of the clubs evenly and comfortably.

Figure 9:
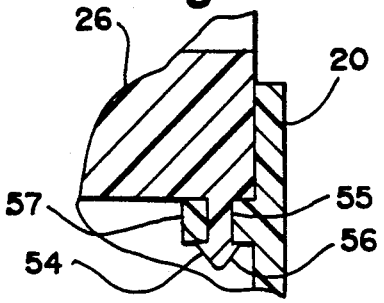
FIG. 9 is an enlarged sectional view taken along the line 9—9 of FIG. 1 showing the attachment of the club separator to the top collar.

Referring to FIGS. 8 and 9, the club separator 26 is attached to the collar 20 by pins 54 which are molded on the club separator. The pins include a cylindrical shank 55 and a frusto-conical head 56. The pins are inserted through openings in lugs 57 which are molded on the inside of the collar.

Figure 10:
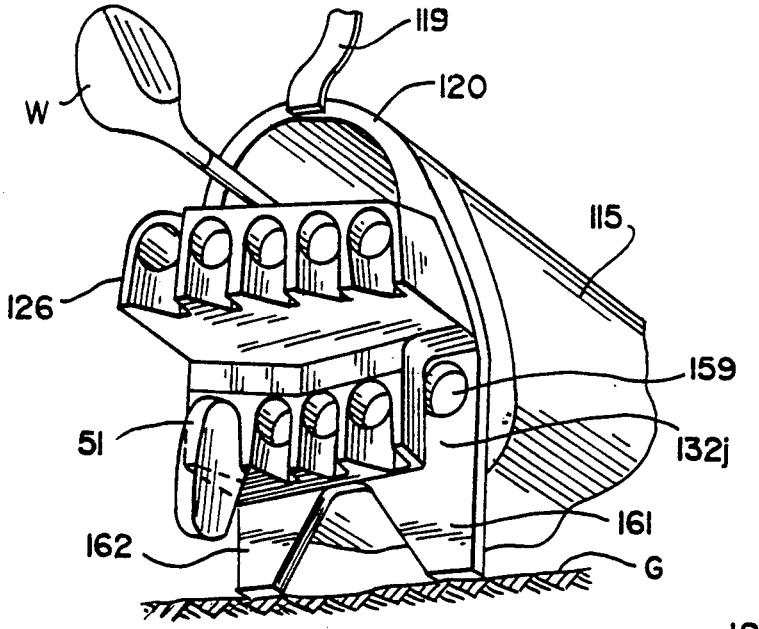
FIG. 10 is a fragmentary perspective view of a modified club separator.
Figure 11:
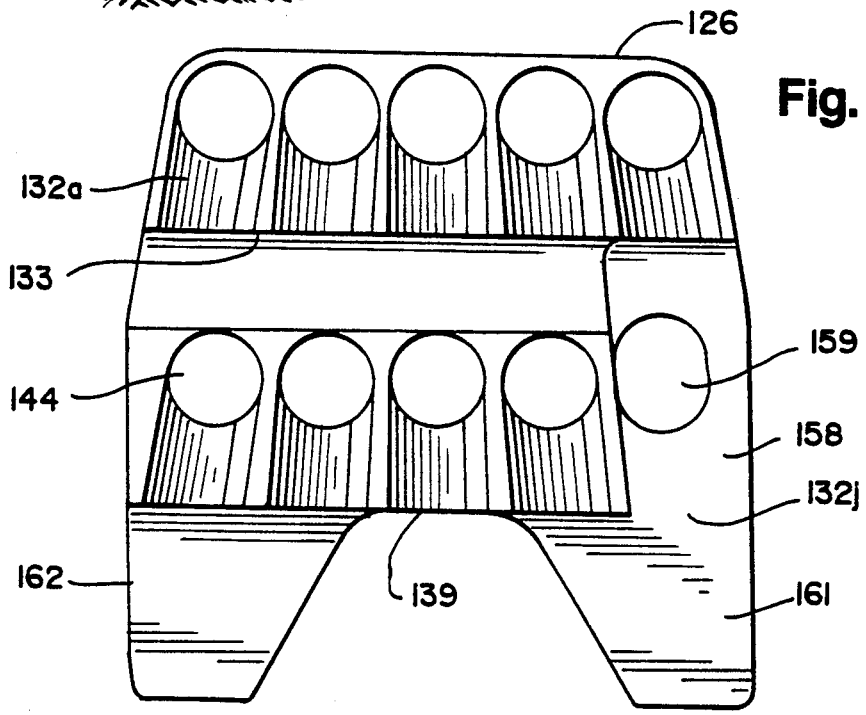
FIG. 11 is a top plan view of the separator of FIG. 10.
Figure 12:
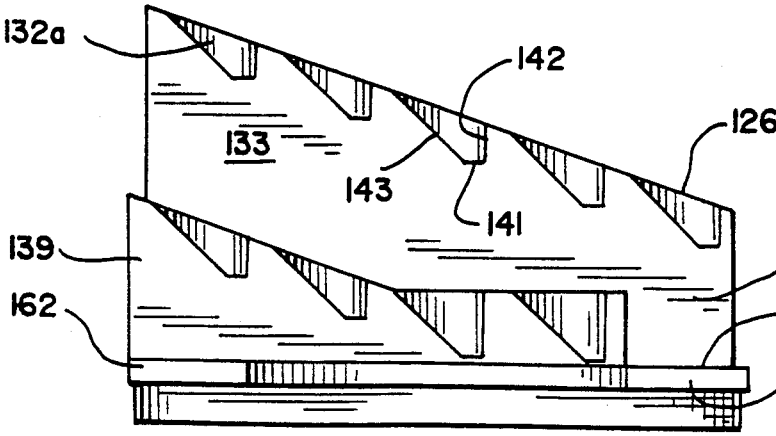
FIG. 12 is a front elevational view of the club separator of FIG. 10.

A modified club separator 126 is illustrated in FIGS. 10–12. The club separator 126 is substantially the same as the club separator 26 and corresponding parts are referred to by reference numerals which are increased by 100. The slot 132*a* does not extend through the rear wall 36 and is intended for an iron club. Instead, the slot 132*j* is designed for a putter. The slot 132*j* includes a bottom wall 158 which extends for the entire width of the slot, and the slot does not include an inclined wall 143. The slot 132*j* extends rearwardly beyond the shaft opening 159 to the intermediate side wall 133. The shaft opening 159 is oval to accommodate oval and non-round putter grips. The slot 132*j* is thereby sized to accommodate a wide variety of sizes and shapes of putters.

A pair of support legs 161 and 162 project forwardly from the front wall 139. The length of the support legs is such that when the golf bag rests on the ground G as illustrated in FIG. 10, the clubheads 51 in the second row of slots do not contact the ground. The support legs are an optional feature, and the club separator can be provided with or without the support legs. The support legs are advantageously molded integrally with the club separator.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A golf bag comprising:

a generally tubular bag portion having an elongated generally tubular body with a longitudinal axis, a bottom, and an open top, and a top member positioned within the open top of the bag portion, the top member having a top surface and a side wall and a plurality of club-receiving slots which are formed in the top surface and extend through the side wall, each of said slots having a bottom surface, a first side surface which extends upwardly from the bottom surface generally perpendicularly thereof, a second inclined side surface which extends upwardly from the bottom surface at an obtuse angle therewith, and a shaft opening which extends through the bottom surface and the inclined side surface along an axis which is generally perpendicular to the bottom surface, where an iron type of golf club having a shaft and a clubhead with a top edge can be retained in each slot by inserting the shaft into the opening, the bottom surface of each slot being wide enough to accommodate the top edge of the different numbered clubheads and clubs from different manufacturers so that the slots do not provide a wedging action and the top edge of the clubhead is supported by the bottom surface and extends beyond said side wall.

2. The golf bag of claim 1 in which the bottom surface of each slot is substantially flat and extends in a plane which is generally perpendicular to the axis of the tubular body.

3. The golf bag of claim 1 in which at least some of the slots are staggered in a stepwise manner by positioning the bottom surfaces thereof progressively farther from the bottom of the bag portion.

4. The golf bag of claim 3 in which the bottom surface of each of the staggered slots is positioned about ½ inch from the bottom surface of the adjacent staggered slot.

5. The golf bag of claim 1 in which the dimension of each of the bottom surfaces between the side surfaces is about ¼ inch.

6. The golf bag of claim 1 in which said obtuse angle is within the range of about 40° to 50°.

7. The golf bag of claim 1 in which the golf bag includes a collar which is secured to the open top of the bag portion, and fastening means for fastening the top member to the collar.

8. The golf bag of claim 1 in which the fastening means comprises pins on one of the top member and the collar and openings for the pins on the other of the top member and the collar.

9. The golf bag of claim 1 including a support member which extends outwardly from the side surface of the top member for supporting the top of the bag portion above the ground so that golf clubs contained in the bag portion do not contact the ground.

10. The golf bag of claim 1 in which the bottom surface of each slot is substantially flat and extends in a plane which is generally perpendicular to the axis of the tubular body and the dimension of each of the bottom surfaces between the side surfaces is about ¼ inch and said obtuse angle of the second inclined side surface is within the range of about 40° to 50°.

11. The golf bag of claim 1 in which the top member is formed from rigid plastic.

12. A golf bag comprising:

a generally tubular bag portion having an elongated generally tubular body with a longitudinal axis, a bottom, and an open top, and a top member positioned within the open top of the bag portion, the top member having first and second rows of club-receiving slots, the first row of slots being positioned farther from the bottom of the bag portion than the second row of slots, each of said slots having a substantially flat bottom surface which extends in a plane which is generally perpendicular to the axis of the tubular body, a first substantially flat side surface which extends upwardly from the bottom surface generally perpendicularly thereof, a second substantially flat inclined side surface which extends upwardly from the bottom surface at an obtuse angle therewith, and a shaft opening which extends through the bottom surface and the inclined side surface along an axis which is generally perpendicular to the bottom surface, whereby an iron type of golf club having a shaft and a clubhead with a top edge can be retained in each slot by inserting the shaft into the opening, the bottom surface of each slot being wide enough to accommodate the top edge of the different numbered clubheads and clubs from different manufacturers so that the slots do not provide a wedging action and the top edge of the clubhead is supported by the bottom surface.

13. The golf bag of claim 12 in which the slots of the first row are staggered in a stepwise manner by positioning the bottom surfaces thereof progressively farther from the bottom of the bag.

14. The golf bag of claim 13 in which at least some of the slots of the second row are staggered in a stepwise manner by positioning the bottom surfaces thereof progressively farther from the bottom of the bag.

15. The golf bag of claim 12 includes a first flat side wall which extends in a plane which is generally parallel to the axis of the tubular body, the notches of the first row extending through said first flat side wall whereby clubheads in the notches can extend beyond the first flat side wall, and a second flat side wall which extends in a plane which is generally parallel to the axis of the tubular body, the notches of the second row extending through said second flat side wall whereby clubheads in the notches can extend beyond the second flat side wall.

16. The golf bag of claim 12 including a support member which extends outwardly from the side surface of the top member for supporting the top of the bag portion above the ground so that golf clubs contained in the bag portion do not contact the ground.

17. The golf bag of claim 12 in which the dimension of each of the bottom surfaces between the side surfaces is about ¼ inch.

18. The golf bag of claim 17 in which said obtuse angle of each of the second inclined side surfaces is within the range of about 40° to 50°.

19. The golf bag of claim 12 in which said obtuse angle of each of the second inclined side surfaces is within the range of about 40° to 50°.

20. The golf bag of claim 12 in which the top member is formed from rigid plastic.

* * * * *